US006745534B2

(12) United States Patent
Kornfalt

(10) Patent No.: US 6,745,534 B2
(45) Date of Patent: Jun. 8, 2004

(54) TRANSITION PROFILE INTENDED TO BE ARRANGED BETWEEN OR IN CONNECTION TO FLOOR SECTIONS

(75) Inventor: Sven Kornfalt, Malmo (SE)

(73) Assignee: Pergo (Europe) AB, Trelleborg (SE)

( * ) Notice: Subject to any disclaimer, the term of this patent is extended or adjusted under 35 U.S.C. 154(b) by 41 days.

(21) Appl. No.: 10/149,679

(22) PCT Filed: Dec. 12, 2000

(86) PCT No.: PCT/SE00/02492

§ 371 (c)(1),
(2), (4) Date: Jun. 27, 2002

(87) PCT Pub. No.: WO01/42589

PCT Pub. Date: Jun. 14, 2001

(65) Prior Publication Data

US 2003/0051426 A1 Mar. 20, 2003

(30) Foreign Application Priority Data

Dec. 13, 1999 (SE) ..... 9904533

(51) Int. Cl.[7] ..... E04C 3/00; E04D 1/36; E04F 15/22; E04B 1/68

(52) U.S. Cl. ..... 52/468; 52/466; 52/395; 52/396.04

(58) Field of Search ..... 52/461, 466–469, 52/395, 396.1, 396.04

(56) References Cited

U.S. PATENT DOCUMENTS

| | | | | | |
|---|---|---|---|---|---|
| 1,772,417 | A | * | 8/1930 | Ellinwood | 52/461 |
| 2,100,238 | A | | 11/1937 | Burgess | |
| 2,996,751 | A | * | 8/1961 | Roby | 16/7 |
| 3,473,278 | A | * | 10/1969 | Gossen | 52/288.1 |
| 3,778,958 | A | * | 12/1973 | Fowler | 52/468 |
| 4,733,510 | A | * | 3/1988 | Werner | 52/202 |
| 4,893,449 | A | * | 1/1990 | Kemper | 52/464 |
| 5,657,598 | A | | 8/1997 | Wilbs et al. | |
| 6,230,385 | B1 | * | 5/2001 | Nelson | 29/450 |
| 6,345,480 | B1 | * | 2/2002 | Kemper et al. | 52/395 |
| 6,550,205 | B2 | * | 4/2003 | Neuhofer, Jr. | 52/464 |
| 6,588,165 | B1 | * | 7/2003 | Wright | 52/506.05 |
| 2002/0095895 | A1 | * | 7/2002 | Daly et al. | 52/464 |
| 2003/0084634 | A1 | * | 5/2003 | Stanchfield | 52/464 |
| 2003/0154678 | A1 | * | 8/2003 | Stanchfield | 52/468 |

FOREIGN PATENT DOCUMENTS

| | | | |
|---|---|---|---|
| DE | 8600241 | | 4/1989 |
| DE | 29711960 | | 10/1997 |
| DE | 002214 | | 5/1998 |
| EP | 000711886 | A1 * | 5/1996 |
| WO | 9822678 | | 5/1998 |

* cited by examiner

*Primary Examiner*—Carl D. Friedman
*Assistant Examiner*—Kevin McDermott
(74) *Attorney, Agent, or Firm*—Stevens, Davis, Miller & Mosher, L.L.P.

(57) ABSTRACT

Transition profile (2) for floors, preferably hard floors comprising a number of joined floor elements which together forms a floor section (1). A transition profile (2) is arranged on one end of a floor section (1) or between two floor sections (1). The transition profile (2) includes an assembly profile (3) and a covering profile (4), whereby the covering profile (4) via a base member (40) is attached to the assembly profile (3) which in its turn is mounted on a foundation (10). The base member (40) is shaped as a longitudinal profile with a, also longitudinal, pivot axle (41). Edge members (42)on the base member (40) have a mainly radial cross section. The assembly profile (3)is provided with two, upwardly directed and mainly parallel cheeks (31) which cheeks (31) are intended to clutch the base member (40) whereby the cover profile (4) can be continuously adapted to height variations in the subfloor, by allowing turning around the pivot axle (41).

16 Claims, 2 Drawing Sheets

TRANSITION PROFILE INTENDED TO BE ARRANGED BETWEEN OR IN CONNECTION TO FLOOR SECTIONS

FIELD OF THE INVENTION

The present invention relates to a transition profile intended to be arranged between, or in connection to, floor sections.

BACKGROUND OF THE INVENTION

Field of the Invention

Hard floors, especially laminate floors will expand and contract under influence of heat, cold and moisture. This problem is solved by leaving a small distance between the floor section and the surrounding walls in cases where the floor surfaces are relatively small. Such distances for allowing the floor to expand will have to be arranged on larger floor surfaces. In cases where the distance between floor and wall is to small or non existent the expansion may cause bulges in the floor or even cause damage to the walls and pipes to radiators. Bulges may also occur if the friction between the floor and the subfloor is to high. Especially pronounced is long corridors where the floor may have to be divided into sections by a gap of one or a few centimetres on every ten metres or so. This gap will be the expansion zone of the floor sections. The gap ought to be covered in some way as it otherwise will collect dirt and is unsightly.

This has so far been solved by nailing or screwing a T-shaped profile in the subfloor so that the gap is covered. The T-profile is most often manufactured of aluminium, wood, wood fibre or the like. There are also other solutions including a U-shaped profile being screwed onto the sub floor and a covering profile being snapped in to the U-shaped profile via a barbed rib.

One problem with the above solution with U-profile and covering profile is that ideal conditions, such as the subfloor flatness, are required. Such a solution will therefore not give a close fit with the floor surfaces as the solution where a T-profile is screwed onto the subfloor. A problem with this method is that nails, screws and the like used for mounting such a T-shaped profile, will be visible which isn't desired It has, through the present invention, been made possible to solve the above mentioned problems whereby a transition profile for floors, preferably hard floors consisting of a number of boards, slats or the like which forms a floor section or are joined with each other to form a floor section has been achieved.

SUMMARY OF THE INVENTION

Accordingly, the invention relates to a transition profile for floors, preferably hard floors comprising a number of joined floor elements which together forms a floor section. One or more floor sections forms a floor whereby a transition profile is intended to be arranged on one end of a floor section or between two floor sections. The transition profile includes an assembly profile and a covering profile, whereby the covering profile, via a base member is attached to the assembly profile which in its turn is mounted on a foundation. The invention is characterised in that the base member is shaped as a longitudinal profile with a, also longitudinal, pivot axle. Edge members on the base member has a mainly radial cross section. The assembly profile is provided with two, upwards directed and mainly parallel, cheeks which cheeks are intended to clutch the base member. The cover profile can be continuously adapted to height variations in the subfloor, by allowing turning around the pivot axle.

The cover profile is preferably, mainly, made of metal, preferably of extruded aluminium. The upper side of the cover profile is coated with a thin decorative thermosetting laminate with an abrasion resistance measured as IP>3000 turns. The assembly profile is attached to the foundation via screws, nails, glue or the like. In order to ensure that the cover profile does not, unintentionally slides out of the assembly profile, at least the edge members and preferably the insides of the cheeks are suitably provided with a coarse surface by etching, shot peening, anodising or the like.

A transition profile according to the present invention is used between floating floor sections and in the transition between a floating floor section and a present, adjacent floor. The longitudinal expansion in the floating floor sections will hereby be absorbed by means of the clearance obtained between the floor sections and the transition profiles. The clearance is depending on the length of the floor sections, temperature difference and variations in the relative moisture content in the premises where the floor is located. A longitudinal clearance of at least 5 mm and at most 50 mm per floor section is preferably allowed.

BRIEF DESCRIPTION OF THE DRAWINGS

The invention is further illustrated by means of attached figures showing two embodiments of the invention whereby.

DETAILED DESCRIPTION OF THE PREFERRED EMBODIMENTS

Figure 1A:
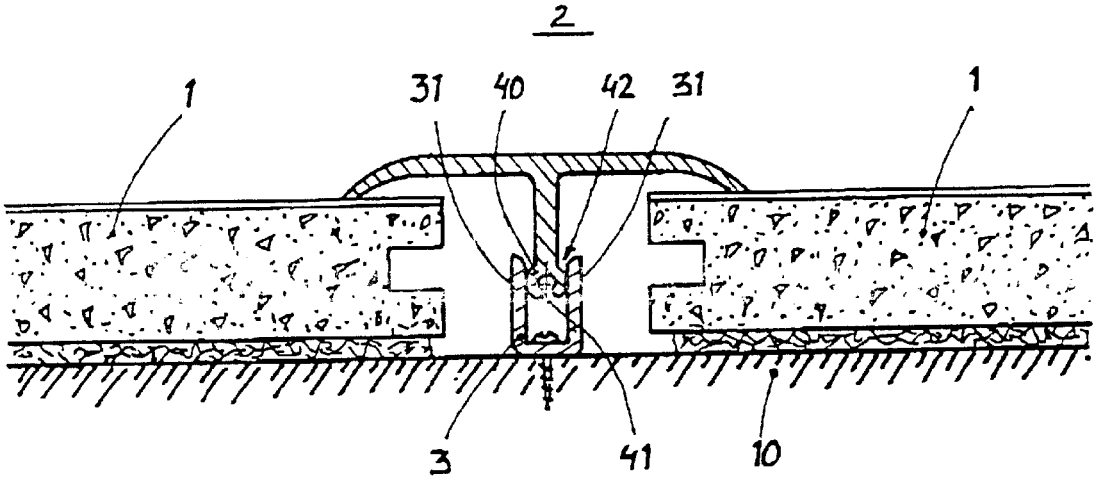
FIGS. 1*a*–1*b* show, in cross-section, a transition profile 2 and parts of two adjoining floor sections 1.
Figure 1B:
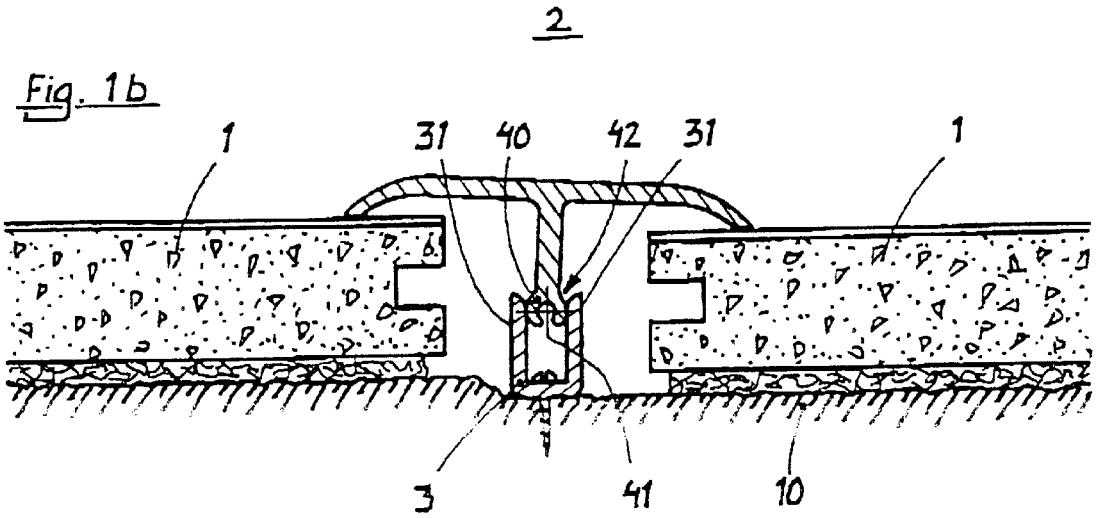

FIGS. 1*a* and 1*b* show, in cross-section, a transition profile 2 for floors, whereby the transition profile 2 is intended to be arranged between two floor sections 1. The transition profile 2 includes an assembly profile 3 and a covering profile 4. The covering profile 4 is mounted by being press fitted into the assembly profile 3 which is attached to the subfloor 10 via screws. The assembly profile 3 have a mainly U-shaped cross-section, whereby two upright cheeks 31 are formed. The cheeks 31 are intended to clutch a base member 40 on the cover profile 4. The base member 40 is shaped as a longitudinal profile and has a, also longitudinal, pivot axle 41. Edge members 42 on the base member 40 has a mainly radial cross-section. The cover profile 4 is allowed to continuously be adapted to level differences in the floor by turning around the pivot axle 41 (FIG. 1*b*). The cover profile 4 is made of extruded aluminium. The upper side of the cover profile is coated with a thin decorative laminate with an abrasion resistance measured as IP>6000 turns. The edge members 42 and the insides of the cheeks 31 are provided with a coarse surface by being etched.

Figure 2:
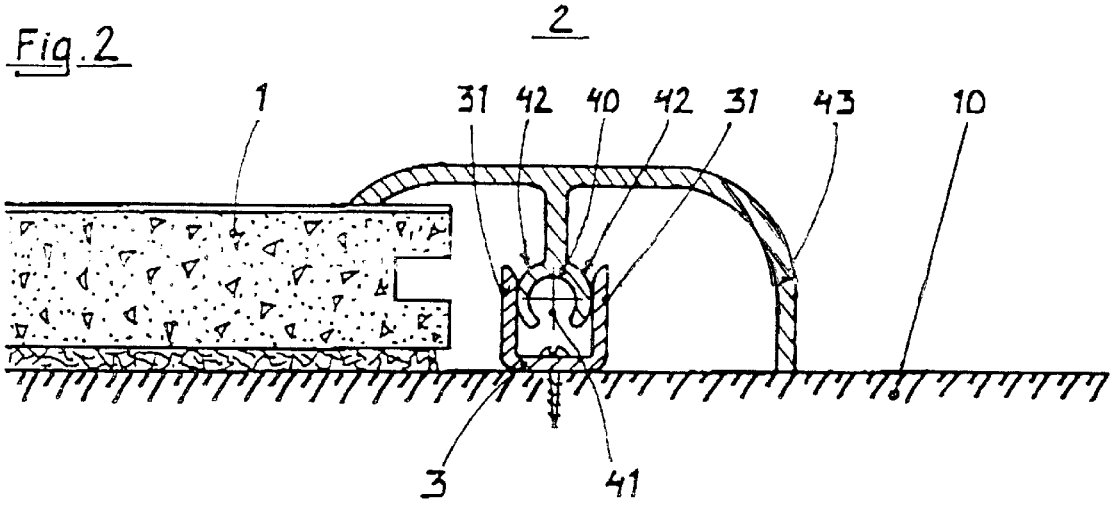
FIG. 2 shows, in cross-section a transition profile 2 in the form of a so-called end profile and parts of an adjacent floor section 1.

FIG. 2 shows, in cross-section a transition profile 2 in the form of a end profile for floors, which is intended to be placed in connection to a floor section 1. The transition profile 1 corresponds mainly with the one described in connection to FIGS. 1*a* and 1*b* above, the cover profile 4 is however provided with an extended leg 43 intended to connect to the subfloor 10.

The invention is not limited to the embodiments shown since these can be varied in different ways within the scope of the invention.

What is claimed is:

1. A transition profile for a floor, whereby a transition profile is intended to be arranged on one end of the floor or between two floor sections, which transition profile includes an assembly profile and a covering profile, whereby the covering profile via a base member is attached to the assembly profile which in turn is mounted on a foundation, wherein the base member is shaped as a longitudinal profile with a, also longitudinal, pivot axle, that edge members are provided on the base member and have a mainly radial cross section and that the assembly profile is provided with two, upwardly directed and mainly parallel, cheeks, which cheeks are intended to clutch the base member whereby the cover profile is continuously adapted to height variations in the subfloor, by allowing turning around the pivot axle, wherein at least the edge members are provided with a coarse surface.

2. The transition profile according to claim 1, wherein the covering profile is comprised of metal, and that the upper side of the covering profile is coated with a thin decorative thermosetting laminate with an abrasion resistance measured as IP>3000 turns.

3. The transition profile according to claim 1, wherein the assembly profile is attached to the foundation.

4. The transition profile according to claim 2, wherein the assembly profile is attached to the foundation.

5. The transition profile of claim 4, wherein the assembly profile is attached by at least one member selected from the group consisting of screws, nails, and glue.

6. The transition profile according to claim 2, wherein at least the edge members are provided with a coarse surface.

7. The transition profile of claim 6, wherein the inside of the cheeks are provided with a coarse surface.

8. The transition profile of claim 7, wherein the coarse surface is provided by at least one method selected from the group of etching, shot peening and anodising.

9. The transition profile of claim 7, wherein the coarse surface is provided by at least one method selected from the group of etching, shot peening and anodising.

10. The transition profile according to claim 3, wherein at least the edge members are provided with a coarse surface.

11. The transition profile of claim 10, wherein the inside of the cheeks are provided with a coarse surface.

12. The transition profile according to claim 11, wherein the coarse surface is provided by at least one method selected from the group of etching, shot peening and anodising.

13. The transition profile according to claim 3, wherein the assembly profile is attached by at least one member selected from the group consisting of screws, nails and glue.

14. The transition profile of claim 1, wherein the inside of the cheeks are provided with a coarse surface.

15. The transition profile according to claim 1, wherein at least the edge members are provided with a coarse surface.

16. The transition profile of claim 1, wherein the floor is a hard floor comprising a number of joined floor elements.

* * * * *